US006022845A

United States Patent [19]

Avila-Garcia et al.

[11] Patent Number: 6,022,845

[45] Date of Patent: Feb. 8, 2000

[54] STABLE HIGH PERFUME, LOW ACTIVE FABRIC SOFTENER COMPOSITIONS

[75] Inventors: Ma. Cristina Avila-Garcia, Mexico City, Mexico; Roberto Escobosa-Reinosa, Kobe, Japan; Miriam Coria-Aguilar, Mexico City, Mexico

[73] Assignee: The Procter & Gamble Co., Cincinnati, Ohio

[21] Appl. No.: 09/051,826

[22] PCT Filed: Oct. 25, 1996

[86] PCT No.: PCT/US96/17151

§ 371 Date: Jun. 30, 1998

§ 102(e) Date: Jun. 30, 1998

[87] PCT Pub. No.: WO97/16516

PCT Pub. Date: May 9, 1997

Related U.S. Application Data

[60] Provisional application No. 60/007,224, Nov. 3, 1995, and provisional application No. 60/022,882, Aug. 20, 1996.

[51] Int. Cl.[7] ..... C11D 3/50; D06M 13/46

[52] U.S. Cl. ..... 510/522; 510/101; 510/102; 510/103; 510/104; 510/105; 510/106; 510/107; 510/524; 510/526; 510/527

[58] Field of Search ..... 510/515, 522, 510/524, 526, 527, 101, 102, 103, 104, 105, 106, 107

[56] References Cited

U.S. PATENT DOCUMENTS

| | | | |
|---|---|---|---|
| 3,790,484 | 2/1974 | Blair | 252/8.9 |
| 3,904,533 | 9/1975 | Neiditch et al. | 252/8.8 |
| 3,915,867 | 10/1975 | Kang et al. | 252/8.8 |
| 4,073,735 | 2/1978 | Ramachandran | 252/8.8 |
| 4,128,485 | 12/1978 | Bauman et al. | 252/8.8 |
| 4,134,838 | 1/1979 | Hooper et al. | 252/8.8 |
| 4,137,180 | 1/1979 | Naik et al. | 252/8.8 |
| 4,152,272 | 5/1979 | Young | 252/8.8 |
| 4,401,578 | 8/1983 | Verbruggen | 252/8.8 |
| 4,767,547 | 8/1988 | Straathoff et al. | 252/8.8 |
| 4,772,403 | 9/1988 | Grandmaire et al. | 252/8.8 |
| 4,808,321 | 2/1989 | Walley | 252/8.8 |
| 4,844,821 | 7/1989 | Mermelstein et al. | 252/8.7 |
| 5,051,196 | 9/1991 | Blumenkopf | 252/8.8 |
| 5,066,414 | 11/1991 | Chang | 252/8.8 |
| 5,133,885 | 7/1992 | Contor et al. | 252/8.6 |
| 5,378,388 | 1/1995 | Pancheri | 252/174.25 |
| 5,413,723 | 5/1995 | Munteanu et al. | 252/8.6 |
| 5,417,868 | 5/1995 | Turner et al. | 252/8.8 |
| 5,492,636 | 2/1996 | Ansari et al. | 252/8.6 |

FOREIGN PATENT DOCUMENTS

| | | | |
|---|---|---|---|
| 2021322 | 7/1990 | Canada . | |
| 0 005 618 | 11/1979 | European Pat. Off. . | |
| 0 243 735 | 4/1987 | European Pat. Off. . | |
| 0 293 955 | 12/1988 | European Pat. Off. | C11D 1/62 |
| 0 336 267 | 10/1989 | European Pat. Off. | C07C 91/26 |
| 2123043 | 1/1984 | United Kingdom | D06M 13/30 |
| WO/91/13143 | 9/1991 | WIPO | C11D 3/50 |
| WO/93/05137 | 3/1993 | WIPO | C11D 17/00 |
| WO/94/06900 | 3/1994 | WIPO | C11D 3/00 |
| WO/94/20597 | 9/1994 | WIPO | C11D 3/00 |
| WO/95/05443 | 2/1995 | WIPO | C11D 3/00 |
| WO/95/08976 | 4/1995 | WIPO | A61K 7/06 |
| WO/95/22594 | 8/1995 | WIPO | C11D 3/50 |
| WO/89/11522 | 11/1998 | WIPO | C11D 1/62 |

*Primary Examiner*—Anthony Green
*Attorney, Agent, or Firm*—Marianne Dressman; Robert B. Aylor

[57] ABSTRACT

The subject invention involves liquid fabric softener compositions for use in the rinse cycle of a laundering process, and concentrates of such compositions, the compositions and concentrates comprising: (a) from about 0.4% to about 24% cationic fabric softener; (b) from about 0.3% to about 10% hydrophobic perfume; (c) from about 0.4% to about 20% nonionic surfactant; (d) from 0% to about 3% water-soluble ionizable inorganic salt; (e) from about 60% to about 98.5% water; and (f) from 0% to about 10% other ingredients; the composition having a ratio of cationic softener to perfume of from about 1:3 to about 5:1, and a ratio of cationic softener to nonionic surfactant of from about 1:2 to about 4:1, the amount of cationic softener plus nonionic surfactant being from about 1% to about 30%; and the composition being a liquid aqueous phase with discrete hydrophobic particles dispersed substantially uniformly therein. The subject invention also involves processes for making such compositions and concentrates.

26 Claims, No Drawings

STABLE HIGH PERFUME, LOW ACTIVE FABRIC SOFTENER COMPOSITIONS

CROSS REFERENCE TO RELATED APPLICATIONS

This application is a 371 of PCT/US96/17151 filed Oct. 25, 1996 which claims priority to U.S. provisional applications Ser. Nos. 60/007,224 and 60/022,882 filed on Nov. 3, 1995 and Aug. 20, 1996 respectively.

TECHNICAL FIELD

The subject invention relates to aqueous-based fabric softener compositions having relatively high levels of perfume and low levels of cationic softener active, the compositions being intended for use in the rinse cycle of laundry washing processes. The subject invention also involves concentrates of such compositions, and processes for making such compositions and concentrates.

BACKGROUND OF THE INVENTION

Fabric softening or conditioning compositions, intended for use in the rinse cycle of the laundering process, generally are aqueous dispersions containing a cationic softener as the active material. Known cationic softeners are typically compounds with a positively charged nitrogen atom and at least one hydrophobic long-chain substituent in the molecule. Suitable cationic softeners are mostly quaternary ammonium salts and imidazolinium salts, and to a lesser extent, alkylated partly elthoxylated polyamines, amine amides, ester amines, and di-quaternary compounds.

Fabric softening or conditioning compositions for use in household washing machines during the rinse cycle are marketed extensively. They provide a countering influence on the disorder of the pile of the fibers at the textile surface as well as an electrostatic charge on it by adsorbing on the textile substrate. Such treatment imparts fluffiness to the fabric, and gives a more pleasant sensation when the fabrics are worn next to the skin. The cationic softeners present in these compositions also serve as carriers for perfume, imparting long-lasting freshness to the laundered fabrics.

It is an object of the subject invention to provide low-cost liquid fabric softening compositions having a relatively low level of cationic softener.

It is a further object of the subject invention to provide such compositions which have a relatively high level of perfume to provide desired freshness to laundered fabrics.

It is also an object of the subject invention to provide concentrates of such compositions.

It is also an object of the subject invention to provide such compositions and concentrates with desired high viscosity.

It is also an object of the subject invention to provide such compositions and concentrates which are stable over long periods of time; the compositions and concentrates maintain their desired viscosity and do not separate into discrete hydrophilic and hydrophobic phases.

It is also an object of the subject invention to provide processes for making such compositions and concentrates.

SUMMARY OF THE INVENTION

The subject invention involves single strength liquid fabric softener compositions for use in the rinse cycle of a laundering process, the composition comprising:

(a) from about 0.4% to about 5% cationic fabric softener;

(b) from about 0.3% to about 1.2% hydrophobic perfume;

(c) from about 0.4% to about 5% nonionic surfactant;

(d) from 0% to about 1% water-soluble ionizable inorganic salt;

(e) from about 90% to about 98.5% water; and (f) from 0% to about 2% other ingredients;

the ratio of cationic softener to perfume being from about 1:3 to about 5:1; the ratio of cationic softener to nonionic surfactant being from about 1:2 to about 4:1, and the amount of cationic softener plus nonionic surfactant being from about 1% to about 7%. The compositions consist of a liquid aqueous phase with discrete hydrophobic particles dispersed substantially uniformly therein. The compositions preferably have a viscosity of from about 50 cp to about 500 cp.

The subject invention also involves concentrates of such single strength compositions, the concentrates comprising an amount of cationic softener plus nonionic surfactant of up to about 30%, and up to about 10% hydrophobic perfume.

The subject invention also involves processes for making such compositions and concentrates.

DETAILED DESCRIPTION OF THE INVENTION

The subject invention compositions include, at a minimum, a cationic fabric softener, a hydrophobic perfume, a nonionic surfactant, and water. All percentages disclosed herein are weight percent unless otherwise indicated.

The subject invention involves single strength fabric softener compositions. As used herein, "single strength" refers to compositions which are intended for addition to the rinse cycle of the laundering process as is. The subject invention also involves concentrates of such single strength compositions, the concentrates preferably being diluted with water prior to addition to the rinse cycle. Optionally, such concentrates can be added directly to the rinse water, in which case the recommended usage amount would be correspondingly altered. Typical concentrates are 2×, 3×, 5× and 10× (1× being single strength), which are then diluted at the time of use or the amount used is correspondingly reduced.

The compositions are in the form of a liquid aqueous phase with discrete hydrophobic particles dispersed substantially uniformly throughout the aqueous phase. The hydrophobic particles are believed to comprise the perfume surrounded by the cationic softener and nonionic surfactant. The size distribution of the particles is determined using known methods, such as by use of a Microtrac®) SRA100 particle size analyzer from Leeds & Northrap Corp. Such methods generally provide a volume percent result which, for particles such as those in the subject invention compositions with a substantially uniform weight distribution, is substantially equivalent to weight percent.

The diameter of the hydrophobic particles of the subject compositions generally approximates a normal distribution. It has been found that compositions having a large percentage of particles which are either too big (diameter of more than about 50 microns) or too small (diameter of less than 1 or 2 microns) are unstable. The mean diameter of the particles is preferably from about 3 microns to about 15 microns, more preferably from about 4 microns to about 12 microns, more preferably still from about 5 microns to about 9 microns, also preferably from about 4 microns to about 6 microns; 90% of the particles have a diameter preferably less than about 50 microns, more preferably less than about 30 microns, more preferably still less than about 20 microns, still more preferably less than about 12 microns; and 90% of the particles have a diameter preferably greater than about 1 micron, more preferably greater than about 2 microns, more preferably still greater than about 3 microns.

The subject invention compositions have a lower ratio of cationic softener to perfume than is typically found in commercial products. It has been found that compositions with such lower ratio are typically unstable; they have a tendency to separate into discrete hydrophobic and hydrophilic phases or layers, the hydrophobic layer comprising much of the perfume. The subject invention compositions are formulated to avoid such phase separation problems.

Compositions and concentrates of the subject invention having a low viscosity of as low as 10 cp, or even 5 cp, can be produced. However, compositions of higher viscosity are preferred for aesthetic reasons. The fabric softening compositions and concentrates of the subject invention preferably have a viscosity of from about 50 cp to about 500 cp, more preferably from about 80 cp to about 300 cp, more preferably still from about 100 cp to about 200 cp. Such higher viscosity compositions present additional challenges to achieving stable compositions and concentrates.

As used herein, "alkyl" means hydrocarbon chain which may be straight or branched, substituted or unsubstituted, and saturated or unsaturated with one or more double bonds. As used herein, "alkanyl" means saturated alkyl, and "alkenyl" means alkyl with one or more double bonds. Unless otherwise indicated, alkyl is preferably as follows. Preferred alkyl is straight chain. Preferred alkyl is unsubstituted. Alkyl having less than 8 carbon atoms is preferably saturated. Alkyl having 8 or more carbon atoms is preferably saturated or unsaturated with one or two double bonds. Where alkyl chain lengths of up to 20 or more carbon atoms are disclosed, about $C_{12}$–$C_{20}$ is preferred, and about $C_{14}$–$C_{18}$ is more preferred. Where alkyl chain lengths of 4 or less are disclosed, $C_1$ and $C_2$ are preferred.

Cationic Fabric Softeners

Cationic fabric softeners useful in the subject invention compositions include compounds having a quaternary nitrogen and at least 1 hydrophobic hydrocarbon moiety. Examples of such compounds include quaternary ammonium compounds and compounds containing a nitrogen present in a cyclic ammonium moiety.

The cationics softeners which are useful herein include the entire class of quaternary ammonium compounds which comprise at least one alkyl moiety having from about 12 to about 30 carbon atoms. Such compounds are, only in part, be represented by the following general formula:

(I)

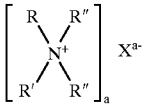

wherein R comprises an alkyl having from about 11 to about 30, preferably from about 12 to about 22, more preferably from about 13 to about 18, carbon atoms. Each R" is independently R or R'; preferably one R" is R and the other is R'. When there are 2 or 3 R groups, one such R group can be arylalkanyl, preferably phenylalkanyl, the alkanyl having from 1 to about 8, preferably from 1 to about 3, more preferably 1, carbon atoms. R' may be lower alkanyl, from about $C_1$ to about $C_4$. Preferably each R' is independently unsubstituted alkanyl or hydroxyalkanyl, such as methyl, ethyl, propyl, or hydroxyethyl. Two of the R' groups may, together with the nitrogen and/or one or more other heteroatoms (preferably nitrogen), form a 5- or 6-membered heteroaryl or heterocyclic ring, such as imidazolyl, tetrazolyl, pyridyl, pyrrolyl, pyrazolyl, pyrazinyl, pyrimidinyl, pyridazinyl, or saturated analog thereof. $X^{a-}$ is any softener composition compatible anion, e.g. halo (preferably chloride or bromide), sulfate, methylsulfate, ethylsulfate, nitrate, acetate, phosphate, benzoate, formate, lactate, oleate, and the like. The symbol "a" represents the ionic valance of the anion and also, therefore, the number of quaternary cationic moieties in association therewith. The anion is merely present as a counterion of the positively charged quaternary ammonium compounds. The scope of this invention is not limited to any particular anion. Preferred anions are chloride and methylsulfate.

Long chain alkyl moieties having from about 12 to about 30 carbon atoms, which are depicted by various "R" and "T" symbols herein can represent a single alkyl moiety or a mixture of different alkyl moieties. Mixtures of such alkyl moieties, in the form of fatty acids or fatty alcohols, are readily and inexpensively obtained from various natural fat and oil sources, such as tallow, lard, coconut oil, soybean oil, palm stearin oil, palm kernel oil, etc. Mixtures of such alkyl chains are referred to herein by referring to such sources. All the fatty moieties from such a source can be used, or only part (or a "cut"), of fatty moieties having the chain length and degree of saturation desired.

Alkyl moieties obtained from tallow are particularly preferred for many of the quaternary ammonium compounds useful in the subject invention, because of their preferred chain length distribution. The term "tallow", as used herein, means glycerides or fatty or alkyl derivatives therefrom, where the fatty acid mixtures typically have an approximate carbon chain length distribution of about 2–4% myristic, 25–35% palmitic, 20–25% stearic, 1–3% palmitoleic, 35–45% oleic, and 24% linoleic. Other sources with similar fatty acid distributions, such as the fatty acids derived from palm stearin oil and from various animal tallows and lard, are also included within the term tallow. The tallow can also be hardened (i.e., hydrogenated) to convert part or all of the unsaturated fatty acid or alkyl moieties to saturated fatty acid or alkyl moieties.

Preferred single alkyl long chain moieties in the subject cationic softeners include stearyl, oleyl, palmityl, palmitoleyl, myristyl, and lauryl.

Preferred cationic softeners have two or more, preferably two, long-chain alkyl groups having from about 12 to about 24 carbon atoms or one said group and an arylalkyl group.

Softeners useful in the subject invention compositions include acyclic quaternary ammonium salts have the formula:

(II)

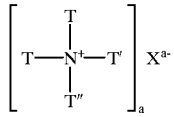

wherein each T is independently about $C_{12}$–$C_{24}$, preferably about $C_{14}$–$C_{18}$, alkyl; alternatively, one T may be arylalkyl, preferably phenylalkyl, the alkyl portion preferably being about $C_1$–$C_4$ alkanyl, the phenylalkyl most preferably being benzyl;

T' is about $C_1$–$C_4$, preferably $C_1$ or $C_2$, alkanyl or hydroxyalkanyl, preferably alkanyl;

T" is T or T', preferably T'; and $X^{a-}$ is an anion as defined above.

Examples of such softeners are the well-known dialkyldimethylammonium salts, such as ditallowdimethylammonium chloride, ditallowdimethylammonium methylsulfate, di(hydrogenatedtallow)-dimethylammonium chloride, dihexadecyldiethylammonium chloride, distearyldimethylammonium chloride, dibehenyldimethylammonium chloride, di(coconut alky))dimethylammonium chloride. Di(hydrogenatedtallow)-dimethylammonium chloride and ditallowdimethylammonium chloride are preferred. Examples of commercially available dialkyldimethylammonium salts usable in the present invention are di(hydrogenatedtallow)dimethylammonium chloride (trade name Adogen® 442), ditallowdimethylammonium chloride (trade name Adogen® 470), distearyidimethylammonium chloride (trade name Arosurf® TA-100), all available from Witco Chemical Company. Dibehenyidimethylammonium chloride is sold under the trade name Kemamine® Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

Cationic softeners useful in the subject invention compositions also include quaternary ammonium compounds having the Formula (III) or (IV), below:

(III)

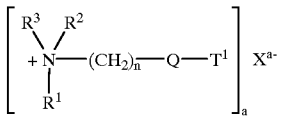

(IV)

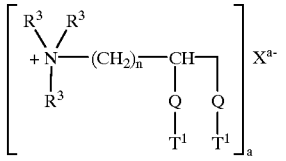

wherein $R^1$ is $—(CH_2)_n—Q—T^1$ or $T^2$;

$R^2$ is $—(CH_2)_n—Q—T^1$ or $T^2$ or $R^3$;

each $R^3$ is independently about $C_1$–$C_4$ alkanyl or about $C_1$–$C_4$ hydroxyalkanyl, or H; preferably $C_1$ or $C_2$ alkanyl or hydroxyalkanyl, preferably alkanyl;

each Q is selected from —O—C(O)—, —C(O)—O—, —O—C(O)—O—, $—NR^4—C(O)—$, and $—C(O)—NR^4—$; preferably from —O—C(O)—and —C(O)—O—;

$R^4$ is H or about $C_1$–$C_4$ alkanyl or about $C_1$–$C_4$ hydroxyalkanyl, preferably H;

each $T^1$ is independently (the same or different) about $C_{11}$–$C_{23}$ alkyl, preferably about $C_{13}$–$C_{17}$;

each $T^2$ is independently about $C_{12}$–$C_{24}$ alkyl, preferably about $C_{14}$–$C_{18}$;

each n is an integer from 1 to about 4, preferably 2; and $X^{a-}$ is a softener-compatible anion, as described hereinabove.

Examples of such quaternary ammonium compounds suitable for use in the subject compositions herein include:

1) N,N-di(tallowyl-oxy-ethyl)-N,N-dimethylammonium chloride;

2) N,N-di(tallowyl-oxy-ethyl)-N-methyl-N-(2-hydroxyethyl)ammonium chloride;

3) N,N-di(2-tallowyloxy-2-oxo-ethyl)-N,N-dimethylammonium chloride;

4) N,N-di(2-tallowyloxyethylcarbonyloxyethyl)-N,N-dimethylammonium chloride;

5) N-(2-tallowoyloxy-2-ethyl)-N-(2-tallowyloxy-2-oxo-ethyl)-N,N-dimethylammonium chloride;

6) N,N, N-tri(tallowyl-oxy-ethyl)-N-methylammonium chloride;

7) N-(2-tallowyloxy-2-oxo-ethyl)-N-(tallowyl)-N,N-dimethylammonium chloride; and 8) 1,2-ditallowyloxy-3-trimethylammoniopropane chloride;

and mixtures of any of the above materials.

Of these, compounds 1–7 are examples of compounds of Formula (III); compound 8 is a compound of Formula (IV).

Particularly preferred is N,N-di(tallowoyl-oxy-ethyl)-N,N-dimethyl-ammonium chloride, where the tallow chains are at least partially unsaturated.

The level of unsaturation of the tallow chain can be measured by the Iodine Value of the corresponding fatty acids, which is preferably from 5 to 100 with two categories of compounds being distinguished, having an Iodine Value below or above 25. For compounds of Formula (III) made from tallow fatty acids having an Iodine Value of from 5 to 25, preferably 15 to 20, it is preferred that a cis/trans isomer weight ratio be greater than about 30/70, preferably greater than about 50/50 and more preferably greater than about 70/30. For compounds of Formula (III) made from tallow fatty acids having an Iodine Value of above 25, the ratio of cis to trans isomers is less critical.

Other examples of suitable quaternary ammoniums for Formula (III) and (IV) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated; replacing "methyl" in the above compounds with ethyl, ethoxy, propyl, propoxy, isopropyl, butyl, isobutyl or t-butyl; replacing "chloride" in the above compounds with bromide, methylsulfate, formate, sulfate, nitrate, and the like.

Certain diamido quaternary ammonium salts useful in the subject invention, largely a subset of Formula (III), have the formula:

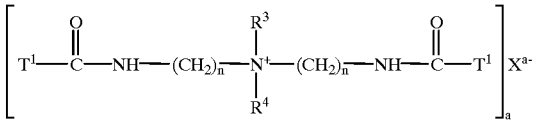

wherein each n is independently an integer from 1 to about 3, preferably 2;

each $T^1$ is independently about $C_{13}$–$C_{21}$ alkyl, preferably about $C_{15}$–$C_{17}$ alkyl;

$R^3$ and $R^4$ are each independently about $C_1$–$C_4$ alkanyl or hydroxyalkanyl, preferably $C_1$–$C_2$; or, differing from general Formula (III), $R^4$ is $—(CyH_{2y}O)_mH$, wherein m is an integer from 1 to about 5, y is 2 or 3; and $X^{a-}$ is an anion as described hereinabove.

Preferred examples of such softeners are those where n is 2, $R^3$ is methyl, $R^4$ is two or three ethoxy or propoxy groups, and $T^1C(O)$ is stearyl, oleyl, palmityl, palmitoleyl, tallowyl, or hydrogenated tallowyl. Particularly preferred examples of such softeners are methylbis(tallowamidoethyl)(2-hydroxyethyl)ammonium methylsulfate and methylbis(hydrogenated tallowamidoethyl)(2-hydroxyethyl) ammonium methylsulfate; these materials are available from Witco Chemical Company under the trade names Varisoft® 222 and Varisoft® 110, respectively.

Certain ester quaternary ammonium compounds useful in the subject invention, also largely a subset of Formula (III), have the formula:

$$[(R^5)_{4-m}—N^+—((CH_2)_n—Y—R^6)_m]_aX^{a-} \quad (VI)$$

wherein each Y is —O—(O)C—, or —C(O)—O—;

m is 2 or 3; m is preferably 2 resulting in diester quaternary ammonium (DEQA) compounds;

each n is an integer from 1 to about 4, preferably 2;

each $R^5$ is independently a short chain about $C_1$–$C_6$, preferably about $C_1$–$C_3$, alkanyl or hydroxyalkanyl or a benzyl, preferably alkanyl or hydroxyalkanyl, e.g., methyl (most preferred), ethyl, propyl, hydroxyethyl, and the like;

each $R^6$ is independently a long chain, about $C_{10}$–$C_{23}$, alkyl, preferably about $C_{13}$–$C_{19}$ alkyl, most preferably about $C_{15}$–$C_{17}$ straight chain alkyl; and the counterion $X^{a-}$ is as defined above.

Examples of such softeners (wherein all long-chain alkyl substituents are straight-chain) include the following:

1) $(CH_3)_2N^+(CH_2CH_2OC(O)R^6)_2Cl^-$

2) $(HOCH(CH_3)CH_2)(CH_3)N^+(CH_2CH_2OC(O)C_{15}H_{_})_2Br^-$

3) $(CH_3)_2N^+(CH_2CH_2OC(O)C_{17}H_{35})_2Cl^-$

4) $(CH_3)(C_2H_5)N^+(CH_2CH_2OC(O)C_{13}H_{27})_2I^-$

5) $(C_3H_7)(C_2H_5)N^+(CH_2CH_2OC(O)C_{15}H_{31})_2—SO_4CH_3$

6)

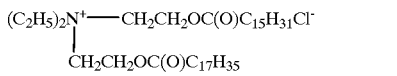

7) $(CH_2CH_2OH)(CH_3)N^+(CH_2CH_2OC(O)R^6)_2Cl^-$ wherein —C(O)$R^6$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)dimethylammonium chloride. Also preferred is di(stearoyloxyethyl) dimethylammonium chloride.

Since the foregoing DEQA compounds are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. DEQA softeners and methods for making them are disclosed in PCT Patent Application No. WO94/20597 (U.S. Priority Application Ser. Nos. 08/024,541 and 08/142,739), which are incorporated herein by reference.

Quaternary imidazolinium compounds useful as cationic softeners in the subject invention compositions include those having the formula:

(VII)

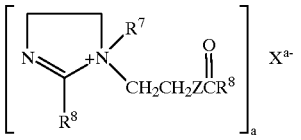

wherein

Z is $NR^9$ or O; $R^9$ being H or $R^7$, preferably H;

$R^7$ is about $C_1$–$C_4$ alkanyl, preferably methyl or ethyl;

each $R^8$ is independently about $C_9$–$C_{25}$, preferably about $C_{11}$–$C_{19}$, more preferably about $C_{13}$–$C_{17}$ alkyl, preferably alkanyl;

$X^{a-}$ is an anion as defined above.

Examples of such cationic softeners useful in the subject invention include 1-methyl-1-(tallowylamido)ethyl-2-tallowyl-4,5-dihydroimidazolinium methylsulfate and 1-methyl-1-(hydrogenated tallowylamido)ethyl-2-(hydrogenatedtallowyl)-4,5-dihydroimidazolinium methylsulfate, sold under the trade names Varisoft® 475 and Varisoft® 445, respectively, by Witco Chemical Company; 1-methyl-1-(palmitoylamido)ethyl-2-octadecyl-4,5-dihydroimidazolinium chloride. Other related examples include 2-heptadecyl-1-methyl-1-(2-stearylamido)ethyl-imidazolinium chloride; and 2-lauryl-1-hydroxyethyl-1-oleyl-imidazolinium chloride.

The cationic softener of the subject invention can also comprise a carboxylic acid salt of a tertiary amine and/or ester amine having the formula:

(VIII)

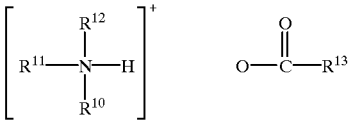

wherein $R^{10}$ is a long chain aliphatic group containing from about 8 to about 30 carbon atoms; each $R^{11}$ and $R^{12}$ are selected from the group consisting of an alkyl group containing from about 1 to about 30 carbon atoms, a hydroxyalkyl group of the formula: $R^{14}OH$ wherein $R^{14}$ is an alkylene group of from about 2 to about 30 carbon atoms, and alkyl ether groups of the formula: $R^{15}O(C_sH_{2s}O)_r$ wherein $R^{15}$ is alkanyl or alkenyl group having from about 1 to about 30 carbon atoms or H, s is an integer from 1 to about 5, preferably 2 or 3, and r is an integer from about 1 to about 30; wherein $R^{10}$, $R^{11}$, $R^{12}$, $R^{14}$ and $R^{15}$ can be ester interrupted groups; and wherein $R^{13}$ is selected from unsubstituted alkanyl, alkenyl, aryl, alkaryl and aralkyl groups having from about 8 to about 30 carbon atoms and substituted alkanyl, alkenyl, aryl, alkaryl, and aralkyl of from about 1 to about 30 carbon atoms wherein the substitutents are selected from halogen, carboxyl, and hydroxyl.

Preferably, $R^{10}$ is alkyl containing from about 12 to about 22 carbon atoms, $R^{12}$ is alkyl of from about 1 to about 22 carbon atoms, and $R^{10}$ is alkyl of from about 1 to about 22 carbon atoms. Particularly preferred tertiary amines for static control performance are those containing unsaturation; e.g., oleyldimethylamine and/or soft tallowdimethylamine.

Preferred amine salts are those wherein the amine moiety is a $C_{11}$–$C_{19}$ alkanyl or alkenyl dimethylamine or a di-$C_{11}$–$C_{19}$ alkanyl or alkenyl methylamine, and the acid moiety is a $C_{11}$–$C_{19}$ alkanyl or alkenyl monocarboxylic acid. The amine and the acid, respectively, used to form the amine salt will often be of mixed chain lengths rather than single chain lengths, since these materials are normally derived from natural fats and oils, or synthetic processes which produce a mixture of chain lengths. Also, it is often desirable to utilize mixtures of different chain lengths in order to modify the physical or performance characteristics of the cationic softener.

These amine salts can be formed by a simple addition reaction, well known in the art, disclosed in U.S. Pat. No. 4,237,155, Kardouche, issued Dec. 2, 1980, which is incorporated herein by reference, The amine salts preferably have a thermal softening point of from about 35° C. to about 100° C.

Examples of preferred tertiary amines as starting material for the reaction between the amine and carboxylic acid to form the tertiary amine salts are: lauryidimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

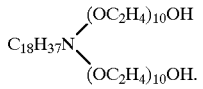

Preferred fatty acids are those wherein $R^{13}$ is a long chain, unsubstituted alkanyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl) acetic acid, and phthalic acid. Preferred carboxylic acids are stearic, oleic, lauric, myristic, palmitic, and mixtures thereof.

Specific preferred amine salts for use in the subject invention are oleyldimethylamine stearate, stearyldimethylamine stearate, stearyidimethylamine myristate, stearyidimethylamine oleate, stearyldimethylamine palmitate, distearylmethylamine palmitate, distearylmethylamine laurate, tallowyldimethylamine stearate, and mixtures thereof. A particularly preferred mixture is oleyidimethylamine stearate and distearylmethylamine myristate, in a ratio of 1:10 to 10:1, preferably about 1:1.

Other cationic softeners useful in the subject invention compositions are disclosed and exemplified in the following references, all of which are incorporated herein by reference: U.S. Pat. Nos. 3,904,533, 3,915,867, 4,127,489, 4,128,485, 4,137,180, 4,401,578, 4,454,049, 4,767,547, 4,772,403, 4,808,321, 5,051,196, 5,066,414; European Patent Application Nos. 0,293,955, 0,336,267; and PCT Patent Application No. WO94/20597.

Preferred cationic softeners useful in the subject invention compositions include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallowoyloxyethyl) dimethylammonium chloride;
14) ditallow imidazolinium methylsulfate;
15) 1-(2-tallowylamidoethyl)-2-tallowyl imidazolinium methylsulfate.

Particularly preferred cationic softeners for the subject invention compositions include ditallow dimethylammonium chloride, di(stearyloxyethyl) dimethylammonium chloride, di(tallowyloxyethyl) dimethylammonium chloride.

The single strength fabric softening compositions of the subject invention comprise from about 0.4% to about 5% cationic fabric softener, preferably from about 0.5% to about 4%, more preferably from about 0.8% to about 3%, more preferably still from about 1% to about 2%. The concentrates of such compositions comprise from about 0.8% to about 24% cationic fabric softener, preferably from about 2% to about 15%, also preferably still from about 3% to about 10%.

Perfumes

As used herein, the term "hydrophobic perfume" or "perfume" is used in its ordinary sense to refer to and include any essentially water insoluble (or very sparingly water soluble) fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds. The formulator has the luxury of choosing from a wide variety of perfume ingredients in order to arrive at a desired perfume formulation.

Examples of perfume ingredients useful in the perfumes of the subject invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional fragrance materials of synthetic or natural origin which may be included in the perfume, if desired, include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methylether; methyl-beta-naphthylketone; coumarin; decylaldehyde; benzaldehyde; 4-tert-butylcyclohexyl acetate; alpha,alpha-dimethylphenethyl acetate; methylphenylcarbinyl acetate; Schiff's base of 4-(4-hydroxy4-methylpentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petit-grain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro4,6,6,7,8,8-hexamethylcyclopenta-gamma-2-benzopyrane; ambroxane; dodecahydro-3a,6,6,9a-tetramethyinaphtho-[2,1b]furan; cedrol; 5-(2,2,3-trimethylcyclopent-3-enyl)-3-methylpentan-2-ol; 2-ethyl4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-pert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones, cis-3-hexenol and esters thereof; indane musk fragrances; tetralin musk fragrances; isochroman musk fragrances; macrocyclic ketones; macrolactone musk fragrances; ethylene brassylate.

The perfumes useful in the subject invention compositions are substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution. Perfumes useful herein and the subject invention compositions are preferably substantially free of, more preferably free of, the solvent butyl carbitol.

The single strength fabric softening compositions of the subject invention comprise from about 0.3% to about 1.2% hydrophobic perfume, preferably from about 0.4% to about 1%, more preferably from about 0.5% to about 0.8%. The concentrates of such compositions comprise from about 0.6% to about 10% hydrophobic perfume, preferably from about 1% to about 8%, also preferably from about 2% to about 5%.

In the subject invention compositions and concentrates, the ratio of cationic softener to perfume is from about 1:3 to about 5:1, preferably from about 1:2 to about 4:1, more preferably from about 1:1 to about 3:1, also preferably from about 1.5:1 to about 2.5:1.

Nonionic Surfactant

The nonionic surfactants which are useful in the subject invention compositions comprise a polar moiety and a hydrophobic moiety. The hydrophobic moiety is preferably at least I alkyl group having from about 8 to about 22, more preferably from about 12 to about 18, also preferably from about 11 to about 15, carbon atoms. For liquid nonionic surfactants, the alkyl chain is preferably from about 10 to about 14 carbon atoms. Examples of polar moieties in such nonionic surfactants include alcohol, ethoxy, polyethoxy, ester, and amide.

Many suitable nonionic surfactants are compounds produced by the condensation of alkylene oxide groups, preferably ethylene oxide, (hydrophilic in nature) with an organic hydrophobic compound, which may be aliphatic or alkylaromatic in nature. The length of the polyoxyalkylene group which is condensed with any particular hydrophobic group can be readily adjusted to yield a water-soluble compound having the desired balance between hydrophilic and hydrophobic.

Preferred nonionic surfactants useful in the subject invention compositions are selected to achieve the desired viscosity, as well as stability, for the compositions. The nonionic surfactants useful in the subject invention compositions preferably have a HLB (hydrophilic/lipophyllic balance) of from about 6 to about 20, more preferably from about 8 to about 15. The preferred nonionic surfactants have a melting point above about 20° C., more preferably from about 25° C. to about 65° C.

Some of the nonionic surfactants useful in the subject invention compositions are generally disclosed in U.S. Pat. Nos. 3,929,678 and 4,844,821, both incorporated herein by reference.

Classes of useful nonionic surfactants include the following:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal® CO-630, marketed by the GAF Corporation; and Triton®D X45, X-114, X-100, and X-102, all marketed by the Rohm & Haas Company.

2. The condensation products of aliphatic alcohols with from about 1 to about 100, preferably from about 2 to about 80, moles of ethylene oxide (ethoxylated fatty alcohols). The alkyl chain of the aliphatic alcohol can either be straight or branched, primary or secondary, and generally contains from about 8 to about 22, preferably from about 10 to about 18, more preferably from about 11 to about 15 carbon atoms. Ethoxylated fatty alcohols preferably have from about 4 to about 60, more preferably from about 5 to about 30 moles of ethylene oxide per mole of alcohol. Examples of such ethoxylated alcohols include the condensation product of myristyl alcohol with about 10 moles of ethylene oxide per mole of alcohol; the condensation product of coconut alcohol (a mixture of fatty alcohols with alkyl chains varying in length from about 10 to about 14 carbon atoms) with about 9 moles of ethylene oxide, and the condensation product of tallow alcohol with about 25 moles of ethylene oxide. Examples of commercially available nonionic surfactants of this type include Tergitol® 15-S-9 moles (the condensation product of $C_{11}$–$C_{15}$ linear alcohol with 9 moles ethylene oxide),Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide). Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), all marketed by Shell Chemical Company; Kyro® EOB (the condensation product of $C_{13}$–$C_{15}$ alcohol with 9 moles of ethylene oxide), marketed by The Procter & Gamble Company; and TAE 25 (the condensation product of tallow alcohol with 25 moles of ethylene oxide), marketed by Hoechst AG.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethlene moieties to this hydrophobic portion tends to increase the water solubility of the molecules as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic® compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfonides containing one alkyl moiety of from about 10 to about 18 carbon atoms and a moiety selected from the group consisting of alkyl and hydroxyalkyl moieties of from about 1 to about 3 carbon atoms. Preferred semi-polar nonionic surfactants are the amine oxide surfactants having the formula:

(IX)

$$R^{20}(OR^{21})_x\overset{\overset{\displaystyle O}{\uparrow}}{N}(R^{22})_2$$

wherein $R^{20}$ is an alkyl, hydroxyalkyl, or alkyl phenyl group or mixtures thereof containing from about 8 to about 22 carbon atoms; $R^{21}$ is an alkylene or hydroxyalkylene group containing from about 2 to about 3 carbon atoms or mixtures thereof; x is from 0 to about 3; and each $R^{22}$ is an alkyl or hydroxyalkyl group containing from about 1 to about 3 carbon atoms or a polyethylene oxide group containing from about 1 to about 3 ethylene oxide groups. The $R^{22}$ groups can be attached to each other, e.g., through an oxygen or nitrogen atom to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, incorporated herein by reference, having a hydrophobic group containing from about 6 to about 30 carbon atoms, preferably form about 10 to about 16 carbon atoms and a polysaccharide, e.g., a polyglycoside, hydrophilic group containing (on average) from about 1.5 to about 10, preferably from about 1.5 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group.

The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyl, dodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyclycosides have the formula:

$$R^{23}O(C_mH_{2m}O)_t(\text{glycosyl})_u \quad \text{(X)}$$

wherein $R^{23}$ is selected from the group consisting of alkyl, alkylphenyl, hydroxyalky, hydroxyalkylphenyl, and mixtures thereof in which the alkyl groups contain from about 10 to about 18, preferably from about 12 to about 14, carbon atoms; m is 2 or 3, preferably 2; t is from 0 to about 10, preferably 0; and u is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^{24}-\overset{\overset{\displaystyle O}{\|}}{C}-N(R^{25})(R^{26}) \quad \text{(XI)}$$

wherein $R^{24}$ is an alkyl group containing from about 7 to about 21 (preferably from about 9 to about 17) carbon atoms and $R^{25}$ and $R^{26}$ are each selected from hydrogen, $C_1$–$C_4$ alkyl, $C_1$–$C_4$ hydroxyalkyl, and $-(C_2H_4O)_wH$ where w varies from about 1 to about 3. Preferred amides are $C_8$–$C_{20}$ ammonia amides, monoethanolamides, diethanolamides, and isopropanolamides.

Polyhydroxy fatty acid amides have the above formula with $R^{25}$ being methyl and $R^{26}$ being glycityl derived from a reduced sugar or alkoxylated derivative thereof. Examples are N-methyl-N-1-deoxyglucityl cocoamide and N-methyl-N-1-deoxyglucityl oleamide. Such compounds and processes for making them are disclosed in U.S. Pat. Nos. 2,965,576, 2,703,798, and 5,194,639, incorporated herein by reference.

8. The condensation products of fatty acids with from about 1 to about 100 moles, preferably from about 2 to about 80 moles, of ethylene oxide (ethoxylated fatty acids). The alkyl chain of the fatty acid preferably contains from about 8 to about 22 carbon atoms, more preferably from about 14 to about 18 carbon atoms. Ethoxylated fatty acids having from about 2 to about 10, especially from about 2 to about 4, moles of ethylene oxide per mole of fatty acid are preferred. Examples of such ethoxylated fatty acids include the condensation product of fatty acids derived from tallow with about 2 moles of ethylene oxide per mole of fatty acid, commercially available as Istemul ® 610 from Arancia Tensoactivos, S.A. de C.V., Guadalajara, Mexico, and the condensation product of stearic acid with about 75 moles of ethylene oxide per mole of fatty acid, commercially available as Pegosperse® 4000 from Glyco Corp.

9. Glycerol esters of fatty acids. Preferred are glycerol monoesters of fatty acids. The alkyl of the fatty acids preferably contains from about 8 to about 22 carbon atoms, more preferably from about 10 to about 20 carbon atoms, more preferably still from about 14 to about 18 carbon atoms. Examples of such surfactants include glycerol monostearate (GMS) commercially available as Emulquim® 70 from Quimic S.A. de C.V., Morelia, Mexico.

10. Sorbitan esters and ethoxylated sorbitan esters. Sorbitan esters are esterified dehydration products of sorbitol. Complex mixtures of anhydrides of sorbitol are collectively referred to herein as "sorbitan." Preferred sorbitan esters comprise a member selected from about $C_{10}$–$C_{26}$, preferably about $C_{12}$–$C_{22}$, acyl sorbitan monoesters and about $C_{10}$–$C_{26}$, acyl sorbitan diesters and ethoxylates of these esters, wherein one or more of the unesterified hydroxyl groups in the esters preferably contain from 1 to about 6 oxyethylene units, and mixtures thereof. Sorbitan esters containing unsaturation (e.g., sorbitan monooleate) can be utilized. Details, including formula, of preferred sorbitan esters can be found in U.S. Pat. Nos. 4,128,484 and 4,022,938, incorporated herein by reference.

Derivatives of preferred sorbitan esters, especially the "lower" ethoxylates thereof (i.e., mono-, di-, and tri-esters wherein one or more of the unesterified —OH groups contain from 1 to about 20 oxyethylene moieties) are also useful in the composition of the present invention. An example of a preferred material is Polysorbate 61 known as Tween® 61 from ICI America.

Commercial sorbitan monostearate is a preferred material. Mixtures of sorbitan stearate and sorbitan palmitate having stearate/palmitate weight ratios varying between 10:1 and 1:10, and 1,5-sorbitan esters are also preferred. Both the 1,4- and 1,5-sorbitan esters are preferred. Other preferred alkyl sorbitan esters for use in the compositions of the subject invention include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Preferred sorbitan ester mixtures can contain up to about 15% by weight of esters of the $C_{20}$–$C_{26}$, and higher, fatty acids, as well as minor amounts of $C_8$, and lower, fatty esters.

Sorbitan esters are readily prepared by reacting hydroxy-substituted sorbitans, particularly the 1,4- and 1,5-sorbitans, with the corresponding acid, ester, or acid chloride in a simple esterification reaction. Commercial materials prepared in this manner will comprise mixtures usually containing minor proportions of uncyclized sorbitol, fatty acids, polymers, isosorbide structures, and the like. In the subject invention compositions, it is preferred that such impurities are present at as low a level as possible.

11. Polyhydroxy fatty acid amides. These surfactants include N-aryloxy polyhydroxy fatty acid amide surfactants of the formula:

(XII)

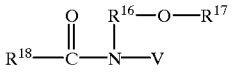

and N-alkyl polyhydroxy fatty acid amide surfactants of the formula:

(XIII)

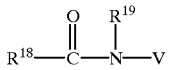

wherein in Formulas (XII) and (XIII): $R^{18}$ is about $C_7$–$C_{21}$ hydrocarbyl, preferably about $C_9$–$C_{17}$ hydrocarbyl, including straight-chain and branched-chain alkyl, or mixtures thereof; $R^{16}$ is about $C_2$–$C_8$ hydrocarbyl including straight-chain, branched-chain and cyclic (including aryl), and is preferably about $C_2$–$C_4$ alkylene, i.e., —$CH_2CH_2$—, —$CH_2CH_2CH_2$—and —$CH_2(CH_2)_2CH_2$—; $R^{17}$ is about $C_1$–$C_8$ straight chain, branched-chain and cyclic hydrocarbyl including aryl and oxyhydrocarbyl, and is preferably about $C_1$–$C_4$ alkyl or phenyl; $R^{19}$ is about $C_1$–$C_6$ alkyl or hydroxyalkyl, including methyl (preferred), ethyl, propyl, isopropyl, butyl, pentyl, hexyl, 2-hydroxyethyl, 3-hydroxypropyl, and the like; and V is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. V preferably will be derived from a reducing sugar in a reductive amination reaction; more preferably V is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for V. It should be understood that it is by no means intended to exclude other suitable raw materials. V preferably will be selected from the group consisting of —$CH_2$—$(CHOH)_z$—$CH_2OH$, —$CH(CH_2OH)$—$(CHOH)_{z-1}$—$CH_2OH$, —$CH_2$—$(CHOH)_2$—$(CHOR^{30})(CHOH)$—$CH_2OH$, where z is an integer from 1 to 5, inclusive, and $R^{30}$ is H or a cyclic mono- or poly- saccharide, and alkoxylated derivatives thereof. Most preferred are glycityls wherein z is 4, particularly —$CH_2$—$(CHOH)_4$—$CH_2OH$.

In compounds of the above Formula (XII), nonlimiting examples of the amine substituent group —$R^{16}$—O—$R^{17}$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranoxyethyl-, 3-(2-methoxyethoxy)propyl-, 2-(2-methoxyethoxy)ethyl, 3-(3-methoxypropoxy)propyl-, 2-(3-methoxypropoxy)ethyl-, 3-(methoxypolyethyleneoxy)propyl-, 3-(4-methoxybutoxy)propyl-, 3-(2-methoxyisopropoxy)propyl, $CH_3O$ $CH_2CH(CH_3)$—and $CH_3OCH_2CH(CH_3)CH_2$—O—$(CH_2)_3$—.

$R^{18}$—CO—N< can be, for example, cocamide, stearamide, oleamide, lauramide, myristamide, capricamide, palmitamide, tallowamide, etc. Synthesis methods for producing polyhydroxy fatty acid amides are found in U.S. Pat. No. 5,194,639 issued Mar. 16, 1993 to Connor, Scheibel and Severson incorporated herein by reference.

Preferred nonionic surfactants for the subject invention compositions include ethoxylated fatty alcohols, ethoxylated fatty acids, and glycerol esters of fatty acids. The subject compositions are preferably substantially free of, more preferably free of, surfactants which are alkoxylated ethers of sterols, such as cholesterol, e.g., ethoxylated cholesterol.

Particularly preferred nonionic surfactants for the subject invention compositions include glycerol mono about $C_{12}$–$C_{20}$ carboxylates, ethoxylated about $C_{12}$–$C_{20}$ fatty acids having from about 2 to about 10 moles of ethylene oxide per mole of mole of fatty acid, and ethoxylated about $C_{12}$–$C_{20}$ fatty alcohols having from about 5 to about 30 moles of ethylene oxide per mole of fatty alcohol.

The fabric softening single strength compositions of the subject invention comprise from about 0.4% to about 5% nonionic surfactant, preferably from about 0.5% to about 4%, more preferably from about 0.8% to about 3%, more preferably still from about 1% to about 2%. The concentrates of such compositions comprise from about 0.8% to about 20% nonionic surfactant, preferably from about 2% to about 15%, also preferably from about 3% to about 10%. The ratio of cationic softener to nonionic surfactant in the subject compositions and concentrates is from about 1:2 to about 4:1, preferably from about 1:1½ to about 3:1, also preferably from about 1:1 to about 2:1, also preferably from about 1:1½ to about 1½ to 1.

The single strength fabric softening compositions of the subject invention preferably comprise a total of the amount of cationic softener plus nonionic surfactant of from about 1% to about 7%, more preferably from about 1.2% to about 6%, more preferably still from about 1.5% to about 4%, still more preferably from about 2% to about 3%. The concentrates of such compositions preferably comprise a total amount of cationic softener plus nonionic surfactant of from about 2% to about 30%, preferably from about 3% to about 25%, more preferably from about 4% to about 20%, also preferably from about 5% to about 15%. The ratio of cationic softener plus nonionic surfactant to perfume in the subject compositions and concentrates is preferably from about 1:1 to about 10:1, more preferably from about 2:1 to about 8:1, more preferably still from about 3:1 to about 6:1.

Viscosity Control Agent—Water-Soluble Ionizable Salts

Control of viscosity of the subject invention compositions and concentrates can optionally be aided by incorporation of water-soluble ionizable inorganic salts. (Process variables and other components also effect composition viscosity.) A wide variety of ionizable salts can be used. Examples of suitable salts are the alkali or alkaline earth halides, e.g., calcium chloride, magnesium chloride, sodium chloride, potassium bromide, and lithium chloride. Calcium chloride is preferred.

The amount of water-soluble ionizable salt incorporated in the subject invention compositions and concentrates depends upon the desired viscosity, and the amounts of cationic softener, anionic surfactant, and perfume in the composition. The proper amount is readily determined by the formulator. Typically, the amount of salt required to achieve a desired viscosity for the subject products increases with (1) lower cationic softener levels and (2) lower nonionic surfactant levels. Care must be taken to not add too much salt, since that can easily result in instability and phase separation in the product.

The subject compositions and concentrates typically comprise from 0% to about 1% water-soluble ionizable inorganic salts, preferably from about 0.03% to about 0.5%, more preferably from about 0.05% to about 0.4%, also preferably from about 0.1% to about 0.3%, also preferably from about 0.2% to about 0.7%, also preferably from about 0.07% to about 0.2%.

Water

The subject invention compositions are aqueous-based suspensions. Because the hydrophobic materials in the subject compositions are not truly soluble in water at the levels present in the compositions, the subject compositions are dispersions of very fine particles, most of which are preferably sub-micron in size. The subject compositions are stable dispersions, maintaining their homogeneity as such fine particle dispersions, and not separating into discrete hydrophilic and hydrophobic phases for long periods of time. Preferably the subject compositions are stable and do not separate into discrete phases for at least about 6 months when stored at 25° C., more preferably for at least about 12 months when stored at 25° C.

The single strength fabric softening compositions of the subject invention comprise from about 90% to about 98.5% water, preferably from about 92% to about 98%, more preferably from about 94% to about 97.5%, also preferably from about 95% to about 97%. The concentrates of such compositions comprise from about 60% to about 97% water, preferably from about 70% to about 96%, also preferably from about 80% to about 95%.

Optional Components

The subject invention compositions can optionally comprise a number of other ingredients commonly found in fabric softening compositions.

Enzymes for treating fabrics can be included in the subject compositions, such enzymes including proteases, lipases, amylases, and cellulases. Preferred enzymes for incorporation in the subject compositions are cellulases, including both bacterial and fungal cellulases. Suitable cellulases are disclosed in U.S. Pat. No. 4,435,307, Barbesgoard et al., issued Mar. 6, 1984, incorporated herein by reference, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Aricula Solander). Suitable cellulases are also disclosed in U.K. Patent Application Nos. 2,075,028 and 2,095,275 and in German Patent 2,247,832. Cellulases disclosed in PCT Patent Application No. WO 91/17243, such as Carezyme® from Novo Corp., are especially preferred.

Cellulase is preferably included in the subject compositions such that the activity of the cellulase is from about 0.5 CEVU to about 100 CEVU per liter of a 1× composition, more preferably from about 4 CEVU to about 25 CEVU, more preferably still from about 7 CEVU to about 12 CEVU. (The activity of a cellulase material (CEVU) is determined from the viscosity decrease of a standard CMC solution as follows. A substrate solution is prepared which contains 35 g/l CMC (Hercules 7 LFD) in 0.1 M tris buffer at pH 9.0. The cellulase sample to be analyzed is dissolved in the same buffer. 10 ml substrate solution and 0.5 ml enzyme solution are mixed and transferred to a viscosimeter (e.g., Haake VT 181, NV sensor, 181 rpm), thermostated at 40° C. Viscosity readings are taken as soon as possible after mixing and again 30 minutes later. The activity of a cellulase solution that reduces the viscosity of the substrate solution to one half under these conditions is defined as 1 CEVU/liter.)

The subject invention compositions preferably comprise a bactericide as a preservative. Examples of bactericides used in the compositions include glutaraldehyde, formaldehyde, 2-bromo-2-nitro-propane-1,3-diol sold by Inolex Chemicals under the tradename Bronopol®, and a mixture of 5-chloro-2-methyl4-isothiazolin-3-one and 2-methyl4-isothiazolin-3-one sold by Rohm and Haas Company under the tradename Kaython®.

The subject invention compositions are preferably maintained somewhat acidic by the incorporation of a small amount of inorganic acid, such as hydrochloric acid. The pH of the subject single strength compositions is preferably from about 2 to about 5, more preferably from about 3 to about 4.

Colorants are preferably incorporated in the subject invention compositions by incorporating dye solutions in the compositions to obtain the desired color for the compositions.

Other optional components which may be incorporated in the subject invention compositions include thickeners, soil release agents, antifoam agents (e.g., silicone), chelants, and others, disclosed, for example, in U.S. Pat. Nos. 4,767,547 and 5,066,414.

The single strength fabric softening compositions of the subject invention comprise from 0% to about 2% of such other optional ingredients, preferably from about 0.02% to about 0.5%. The concentrates of such compositions comprise from 0% to about 10% of such other optional ingredients, preferably from about 0.05% to about 5%.

The subject invention compositions preferably consist substantially of, more preferably consist of, the cationic fabric softeners, hydrophobic perfumes, nonionic surfactants, water-soluble ionizable inorganic salts, water, and optional components disclosed hereinabove, in the amounts disclosed hereinabove.

Process

The subject invention compositions and concentrates are typically made in a mixing vessel equipped with a high-speed agitator and a water jacket for heating or cooling. For example, batches can be made in a mixing vessel having a capacity of 3 liters, the vessel being cylindrical in shape, 16 cm in diameter and 23 cm high. The agitator used to mix the batch has a standard impeller having 6 blades having a pitch of 90°, the blades extending 4 cm from the center of the shaft. The "standard" agitator speed for such mixing vessel and agitator for the subject invention processes is a high speed, about 700–1000 rpm. Larger mixing vessels will typically have larger diameter agitator impellers run at a slower rpm, and smaller mixing vessels will typically have smaller diameter agitator impellers run at faster rpm, such that the tip speed of the impellers are about the same.

The processes of the subject invention used for making the subject invention compositions preferably involve four mixing stages.

The first mixing stage is carried out at a temperature above the melting points of the cationic softener and the nonionic surfactant. The water is added to the mixing vessel and is preheated, either before or after addition, to the desired temperature for the first mixing stage, typically from about 30° C. to about 70° C., preferably from about 40° C. to about 60° C. The agitator is preferably run at the standard speed throughout the first stage of mixing. Dye solution, if any, is added to the mixing vessel and blended with the water. Any hydrochloric acid is added slowly to the mixing vessel and blended. The cationic softener and nonionic surfactant are preheated and premixed at a temperature above their melting points, preferably at least about 5° C. and preferably up to about 40° C. above the water temperature. The cationic softener/nonionic surfactant premix is added slowly over a period to the mixing vessel, preferably at a substantially constant rate of addition of from about 10 ml/min to about 40 ml/min, with continuous agitation. Other minor ingredients, such as antifoam agents, preservatives, enzymes, soil release agents, etc., (but preferably not chelants), if desired in the composition, are added and blended with continuous agitation.

The temperature of the mixture in the mixing vessel is adjusted to from about 40° C. to about 60° C., preferably from about 45° C. to about 55° C. with continuing agitation, preferably at the standard speed, to prepare for the second stage of mixing. The second stage of mixing involves the slow addition of perfume to the mixing vessel at this adjusted temperature, preferably with continued agitation at the standard speed. The perfume is added over a period, preferably at a substantially constant rate of addition of from about 10 ml/min to about 40 ml/min. Agitation is continued for at least about 1 min, preferably for at least about 2 min, after addition of the perfume is completed.

The mixture in the mixing vessel is homogenized in the third stage, preferably using a high-sheer (very high speed) mixer, such as a Greerco homomixer model 1-L at about 6000 to 8000 rpm. Alternatively, adequate homogenization can be achieved for some compositions by mixing with a mixer such as that used for the previous steps, for longer time periods. Homogenizing is preferred because of the resulting compositions exhibit less hydrophobic particle size variation. The hydrophobic perfume is dispersed as small hydrophobic particles held in suspension by the surfactant activity of the cationic softener and nonionic surfactant. The mixture is preferably homogenized at a temperature of less than about 30° C. Alternatively, the homogenization or additional mixing can be carried out at temperatures above 30° C., preferably up to about 40° C., as long as the fourth stage of mixing is carried out at about the same temperature as the third stage. The mixture is preferably homogenized or mixed until the diameter of the hydrophobic particles is as specified hereinabove. Care must be taken not to over-homogenize and produce hydrophobic particles smaller than desired.

The fourth stage of mixing for the subject processes is carried out by adding, over a period, the water-soluble, ionizable inorganic salt to the mixture, preferably with the agitator running at about one-half the standard speed (moderate speed). The salt is preferably added as a concentrated aqueous solution (for example, about 15% salt), at a substantially constant rate or intermittently a portion at a time at a rate of from about 5 ml/min to about 40 ml/min, with constant agitation. Agitation for too long after addition of the salt is completed can result in an unstable product, so such agitation is continued preferably for at most about 4 minutes, more preferably for at most about 2 minutes, after addition of the salt is completed. If desired in the subject compositions, chelants are preferably added during the fourth mixing stage.

In the above process steps, materials are added "over a period" to aqueous mixtures being agitated. This means that the material is added at a slow enough rate (constant or intermittent) to insure that the material is homogeneously blended into the aqueous mixture.

EXAMPLES

The following non-limiting examples exemplify compositions and concentrates of the subject invention.

Example 1

A single strength composition having the following formula is made by the process described below.

| Component | Example 1 (%) |
|---|---|
| DTDMAC | 1.14 |
| GMS | 1.14 |
| Perfume | 0.6 |
| Calcium Chloride | 0.1 |
| Hydrochloric acid | 0.007 |
| Silicone | 0.015 |
| Dye | 0.0045 |
| Water | balance |

The composition of Example 1 having a total batch weight of 1 kg is made in a mixing vessel which is generally cylindrical in shape having a diameter of 16 cm and a height of 23 cm, and having a capacity of about 4 liters.

The water, at a temperature of 60° C., is added to the mixing vessel, and the agitator, having an impeller with 6 blades of 4 cm length (measured from the center of the shaft to the blade tip) at a pitch of 90°, is run at a speed of 1070 rpm. The dye solution is added to the mixing vessel and blended with the water. The hydrochloric acid is added slowly to the mixing vessel over a period of 0.5 minutes and blended with continuous agitation. The DTDMAC and GMS are melted, premixed to a homogeneous liquid, and heated to 75° C. This premix is added to the mixing vessel using a metering pump to provide a constant rate of addition 22 ml/min. The silicone is added to the mixing vessel and blended with continued agitation.

Agitation is continued at 1070 rpm, and the mixture is allowed to cool to 50° C. The perfume is added with a metering pump at a constant rate 22 ml/min with continued mixing at 1070 rpm, the mixing being continued for two minutes after addition of the perfume is complete.

The mixture is circulated through a homogenizer, Greerco model 1-L, run at a speed of 6500 rpm, for about 1 min, thus producing hydrophobic particles having a mean diameter of about 6 microns with 90% of the particles having a diameter of less than about 12 microns and 90% of the particles having a dieameter of greater than about 3 microns.

The calcium chloride is blended into the homogenized mixture in the mixing vessel with the agitator running at the speed of 500 rpm. The calcium chloride is added a portion at a time intermittently over a period of two minutes with continuous agitation. The agitation is stopped 2 minutes after all the calcium chloride is added.

The resulting final product is allowed to cool to room temperature, and is filled into individual bottles, providing the finished product.

Examples 2–4

Single strength compositions having the following formulas are made by the process described in Example 1.

| Component | Example 2 (%) | Example 3 (%) | Example 4 (%) |
|---|---|---|---|
| DTDMAC | 0.88 | 2.0 | 3.14 |
| Istemul ® 610 | 1.21 | 1.0 | 1.15 |
| Perfume | 0.8 | 0.5 | 0.8 |
| Calcium Chloride | 0.1 | 0.4 | 0 |
| Dye solution | 0.20 | 0.20 | 0.20 |

-continued

| Component | Example 2 (%) | Example 3 (%) | Example 4 (%) |
|---|---|---|---|
| Others (antifoam, HCl, Kaython ®) | 0.25 | 0.25 | 0.25 |
| Water | balance | balance | balance |

Examples 5–7

Single strength compositions having the following formulas are made by the process described in Example 1.

| Component | Example 5 (%) | Example 6 (%) | Example 7 (%) |
|---|---|---|---|
| DSOEDMAC | 1.15 | 1.31 | 1.53 |
| GMS | 1.15 | 1.82 | 1.32 |
| Perfume | 0.3 | 0.8 | 0.5 |
| Calcium Chloride | 0.1 | 0.1 | 0.5 |
| Dye solution | 0.20 | 0.20 | 0.20 |
| Others (antifoam, HCl, Kaython ®) | 0.25 | 0.25 | 0.25 |
| Water | balance | balance | balance |

Examples 8–9

Concentrates having the following formulas are made by the process described in Example 1.

| Component | Example 8 (3x) (%) | Example 9 (5x) (%) |
|---|---|---|
| DTDMAC | 3.42 | 7.0 |
| Nonionic | 3.42 (GMS) | 6.0 (Istemul ® 610) |
| Perfume | 1.8 | 2.5 |
| Calcium chloride | 0.3 | 0.7 |
| Dye solution | 0.6 | 1.0 |
| Others (antifoam, HCl, Kaython ®) | 0.7 | 1.0 |
| Water | balance | balance |

Examples 10–11

Single strength compositions having the following formulas are made by the process described below.

| Component | Example 10 (%) | Example 11 (%) |
|---|---|---|
| DTDMAC | 1.14 | 1.14 |
| GMS | 1.14 | 1.14 |
| Perfume | 0.7 | 0.7 |
| HCl | 0.2 | 0.2 |
| Silicone | 0.9 | 0.9 |
| Dye solution | 0.05 | 0.05 |
| Cellulase | — | 0.00095 (9 CEVU/liter) |
| Others (antifoam, HCl, Kaython ®) | 0.25 | 0.25 |
| Water | Balance | Balance |

The above composition of Example 10, having a total batch weight of 1 kg, is made in a mixing vessel which is generally cylindrical in shape having a diameter of 16 cm and a height of 23 cm, having a capacity of 4 liters.

The water, at a temperature of 38° C., is added to the mixing vessel, and the agitator, having an impeller with 6 blades of 4 cm length (measured from the center of the shaft to the blade tip) at a pitch of 90°, is run at a speed of 750 rpm. The dye solution is added to the mixing vessel and blended with the water. The hydrochloric acid is added slowly to the mixing vessel over a period of 0.5 minute and blended with continuous agitation. The DTDMAC and GMS are melted, premixed to a homogeneous liquid, and heated to 63° C. The premix is added to the mixing vessel using a metering pump to provide a constant rate of addition of 22 ml/min. The silicone is added to the mixing vessel and blended with continued agitation.

Agitation is continued at 750 rpm, until the temperature of the vessel contents is 42° C. The perfume is added with a metering pump at a constant rate of 22 min with continued mixing at 750 rpm, the mixing being continued for two minutes after addition of the perfume is completed. At this stage, the remaining minor ingredients are incorporated with additional mixing until they are uniformly dispersed.

The resulting final product is allowed to cool and is filled into individual bottles, providing the finished product.

While particular embodiments of the subject invention have been described, it will be obvious to those skilled in the art that various changes and modifications to the subject invention can be made without departing from the spirit and scope of the invention. It is intended to cover, in the appended claims, all such modifications that are within the scope of this invention.

What is claimed is:

1. A single strength liquid fabric softener composition comprising:

(a) from about 0.4% to about 5% cationic fabric softener;

(b) from about 0.3% to about 1.2% hydrophobic perfume;

(c) from about 0.4% to about 5% nonionic surfactant;

(d) from 0% to about 1% water-soluble ionizable inorganic salt;

(e) from about 90% to about 98.5% water; and (f) from 0% to about 2% other conventional ingredients selected from the group consisting of enzymes, bactericides, inorganic acid, colorants, thickeners, soil release agents, antifoam agents, and chelants;

the composition having a ratio of cationic softener to perfume of from about 1:3 to about 5:1, and a ratio of cationic softener to nonionic of from about 1:2 to about 4:1; the amount of cationic softener plus nonionic surfactant being from about 1% to about 7%; and the composition being a liquid aqueous phase with discrete hydrophobic particles of said perfume surrounded by said cationic softener and said nonionic surfactant dispersed substantially uniformly therein, the hydrophobic particles having a mean diameter of from about 4 microns to about 12 microns with 90% of the particles having a diameter of less than about 30 microns and 90% of the particles having a diameter greater than about 1 micron.

2. The composition of claim 1 wherein the composition comprises from about 0.8% to about 3% cationic fabric softener, from about 0.8% to about 3% nonionic surfactant, and from 0% to about 0.7% water-soluble ionizable inorganic salt which is an alkali or alkaline earth halide; the ratio of cationic softener to perfume being from about 1:2 to about 4:1; the ratio of cationic softener to nonionic surfactant being from about 1:2 to about 3:1; the viscosity of the composition being from about 50 cp to about 500 cp; and the hydrophobic particles having a mean diameter of from about 3 microns to about 15 microns with 90% of the particles having a diameter of less than about 50 microns and 90% of the particles having a diameter of greater than about 1 micron.

3. The composition of claim 2 wherein the cationic softener has the formula:

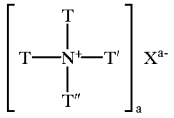

wherein (a) each T is independently a $C_{12}$–$C_{24}$ alkyl; or one T is phenylalkanyl, the alkanyl being a $C_1$–$C_4$;

(b) T' is a $C_1$–$C_4$ alkanyl or hydroxyalkanyl;

(c) T" is T or T'; and (d) $X^{a-}$ is any softener composition compatible anion, a being the ionic value of the anion.

4. The composition of claim 3 wherein each T is independently a $C_{14}$–$C_{18}$ alkyl, and T' and T" are both methyl or ethyl.

5. The composition of claim 2 wherein the cationic softener has the formula:

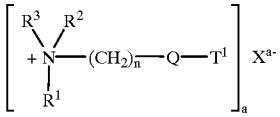

wherein (a) each Q is selected from the group consisting of —O—C(O)—, —C(O)—O—, —O—C(O)—O—, —$NR^4$—C(O)—, and —C(O)—$NR^4$—;

(b) $R^1$ is —$(CH_2)_n$—Q—$T^1$ or $T^2$;

(c) $R^2$ is —$(CH_2)_n$—Q—$T^1$ or $T^2$ or $R^3$;

(d) each $R^3$ is independently a $C_1$–$C_4$ alkanyl or about $C_1$–$C_4$ hydroxyalkanyl, or H;

(e) $R^4$ is H or a $C_1$–$C_4$ alkanyl or a $C_1$–$C_4$ hydroxyalkanyl;

(f) each $T^1$ is independently a $C_{11}$–$C_{23}$ alkyl;

(g) each $T^2$ is independently a $C_{12}$–$C_{24}$ alkyl;

(h) each n is an integer from 1 to a 4; and (j) $X^{a-}$ is any softener composition compatible anion, a being the ionic value of the anion.

6. The composition of claim 5 wherein Q is —O—C(O)—, $R^1$ is —$(CH_2)_n$—Q—$T^1$, $R^2$ and $R^3$ are both $C_1$–$C_2$ alkanyl or hydroxyalkanyl, $R^4$ is H, each $T^1$ is a $C_{13}$–$C_{17}$ alkyl, and n is 2.

7. The composition of claim 2 wherein the cationic softener has the formula:

$$[(R^5)_{4-m}—N^+—((CH_2)_n—Y—R^6)_m]_aX^{a-}$$

wherein (a) each Y is —O—(O)C—, or —C(O)—O—;

(b) m is 2 or 3;

(c) each n is an integer from 1 to about 4;

(d) each $R^5$ is independently a $C_1$–$C_4$ alkanyl or hydroxyalkanyl;

(e) each $R^6$ is independently a $C_{11}$–$C_{23}$ alkyl; and $X^{a-}$ is any softener composition compatible anion, a being the ionic value of the anion.

8. The composition of claim 7 wherein m is 2, each n is 2, each $R^5$ is $C_1$–$C_2$ alkanyl or hydroxyalkanyl, and each $R^6$ is a $C_{13}$–$C_{17}$ alkyl.

9. The composition of claim 2 wherein the cationic softener has the formula:

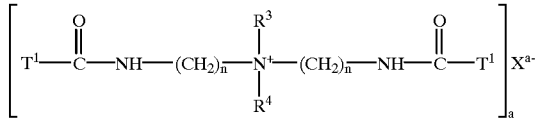

wherein (a) each n is an integer from 1 to about 3;

(b) each $T^1$ is independently a $C_{13}$–$C_{21}$ alkyl;

(c) $R^3$ and $R^4$ are each independently a $C_1$–$C_4$ alkanyl or hydroxyalkanyl; and (d) $X^{a-}$ is any softener composition compatible anion, a being the ionic value of the anion.

10. The composition of claim 9 wherein n is 2, each $T^1$ is a $C_{13}$–$C_{17}$ alkyl, and $R^3$ and $R^4$ are each $C_1$–$C_2$ alkanyl or hydroxyalkanyl.

11. The composition of claim 2 wherein the cationic softener has the formula:

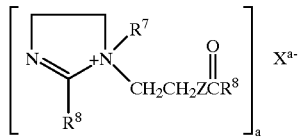

wherein (a) Z is $NR^9$ or O, $R^9$ being H or $R^7$;

(b) each $R^7$ is independently a $C_1$–$C_4$ alkanyl;

(c) each $R^8$ is independently a $C_9$–$C_{25}$ alkyl; and (d) $X^{a-}$ is any softener composition compatible anion, a being the ionic value of the anion.

12. The composition of claim 11 wherein Z is NH, $R^7$ is methyl, and each $R^8$ is independently a $C_{11}$–$C_{17}$ alkyl.

13. The composition of claim 2 wherein the cationic softener is selected from the group consisting of 1) ditallow dimethylammonium chloride (DTDMAC);

2) dihydrogenated tallow dimethylammonium chloride;

3) dihydrogenated tallow dimethylammonium methylsulfate;

4) distearyl dimethylammonium chloride;

5) dioleyl dimethylammonium chloride;

6) dipalmityl hydroxyethyl methylammonium chloride;

7) stearyl benzyl dimethylammonium chloride;

8) tallow trimethylammonium chloride;

9) hydrogenated tallow trimethylammonium chloride;

10) $C_{12}$–$C_{14}$ alkyl hydroxyethyl dimethylammonium chloride;

11) $C_{12}$–$C_{18}$ alkyl dihydroxyethyl methylammonium chloride;

12) di(stearoyloxyethyl) dimethylammonium chloride (DSOEDMAC);

13) di(tallowoyloxyethyl) dimethyl ammoniumchloride;

14) ditallow imidazolinium methylsulfate; and 15) 1-(2tallowylamidoethyl)-2-tallowyl imidazolinium methylsulfate.

14. The composition of claim 12 wherein the nonionic surfactant is selected from the group consisting of glycerol esters of fatty acids, ethoxylated fatty acids, and ethoxylated fatty alcohols.

15. The composition of claim 2 wherein the nonionic surfactant is selected from the groups consisting of glycerol mono $C_{10}$–$C_{18}$ carboxylates, ethoxylated $C_{10}$–$C_{18}$ fatty acids having from 2–10 moles of ethylene oxide per mole of fatty acid, and ethoxylated $C_{10}$–$C_{18}$ fatty alcohols having 5–30 moles of ethylene oxide per mole of fatty alcohol.

16. The composition of claim 1 wherein the composition comprises:

(a) from about 1% to about 2% cationic softener;

(b) from about 0.5% to about 0.8% perfume;

(c) from about 0.8% to about 3% nonionic surfactant;

(d) from 0.05% to about 0.4% water-soluble ionizable salt; and (e) from about 94% to about 97.5% water;

the composition having a ratio of cationic softener to perfume of from about 1:1 to about 3:1, and a ratio of cationic softener to nonionic surfactant of from about 1:1.5 to about 2:1; the composition being a liquid aqueous phase with discrete hydrophobic particles of said perfume surrounded by said cationic softener and said nonionic surfactant dispersed substantially uniformly therein; the pH of the composition being from about 2 to about 5; the hydrophobic particles having a mean diameter of from about 4 microns to about 12 microns with 90% of the particles having a diameter of less than about 30 microns and 90% of the particles having a diameter greater than about 1 micron; and the nonionic surfactant being selected from the group consisting of glycerol monoesters of fatty acids, ethoxylated fatty acids, and ethoxylated fatty alcohols.

17. The composition of claim 16 wherein the cationic softener is DTDMAC, and the nonionic surfactant is selected from the group consisting of glycerol mono $C_{10}$–$C_{18}$ carboxylates, ethoxylated $C_{10}$–$C_{18}$ fatty acids having from 2–10 moles of ethylene oxide per mole of fatty acid, and ethoxylated $C_{10}$–$C_{18}$ fatty alcohols having 5–30 moles of ethylene oxide per mole of fatty alcohol.

18. A liquid fabric softener concentrate comprising:

(a) from about 0.8% to about 24% cationic fabric softener;

(b) from about 0.6% to about 10% hydrophobic perfume;

(c) from about 0.8% to about 20% nonionic surfactant;

(d) from 0% to about 1% water-soluble, ionizable inorganic salt;

(e) from about 60% to about 97% water; and (f) from 0% to about 10% other conventional ingredients selected from the group consisting of enzymes, bactericides, inorganic acid, colorants, thickeners, soil release agents, antifoam agents, and chelants;

the concentrate having a ratio of cationic softener to perfume of from about 1:3 to about 5:1, and a ratio of cationic softener to nonionic surfactant of from about 1:2 to about 4:1; the amount of cationic softener plus nonionic surfactant being from about 2% to about 30%; and the concentrate being a liquid aqueous phase with discrete hydrophobic particles of said perfume surrounded by said cationic softener and said nonionic surfactant dispersed substantially uniformly therein, the hydrophobic particles having a mean diameter of from about 4 microns to about 12 microns with 90% of the particles having a diameter of less than about 30 microns and 90% of the particles having a diameter greater than about 1 micron.

19. The concentrate of claim 18 wherein the viscosity of the concentrate is from about 50 cp to about 500 cp.

20. The concentrate of claim 19 wherein the concentrate comprises:

(a) from about 2% to about 15% cationic softener;

(b) from about 1% to about 8% perfume;

(c) from about 2% to about 15% nonionic surfactant;

(d) from 0% to about 2% water-soluble, inorganic salt which is an alkali or alkaline earth halide; and (e) from about 70% to about 95% water; the concentrate having a ratio of cationic softener to perfume of from about 1:1 to about 3:1, and a ratio of cationic softener to nonionic of from about 1:1.5 to about 2:1; the amount of cationic softener plus nonionic surfactant being from about 4% to about 20%; the viscosity of the concentrate being from about 50 cp to about 500 cp; and the concentrate being a liquid aqueous phase with discrete hydrophobic particles dispersed substantially uniformly therein.

21. The concentrate of claim 20 wherein the cationic softener is selected from the group consisting of:

1) ditallow dimethylammonium chloride (DTDMAC);

2) dihydrogenated tallow dimethylammonium chloride;

3) dihydrogenated tallow dimethylammonium methylsulfate;

4) distearyl dimethylammonium chloride;

5) dioleyl dimethylammonium chloride;

6) dipalmityl hydroxyethyl methylammonium chloride;

7) stearyl benzyl dimethylammonium chloride;

8) tallow trimethylammonium chloride;

9) hydrogenated tallow trimethylammonium chloride;

10) $C_{12}$–$C_{14}$ alkyl hydroxyethyl dimethylammonium chloride;

11) $C_{12}$–$C_{18}$ alkyl dihydroxyethyl methylammonium chloride;

12) di(stearoyloxyethyl) dimethylammonium chloride (DSOEDMAC);

13) di(tallowoyloxyethyl) dimethyl ammoniumchloride;

14) ditallow imidazolinium methylsulfate; and 15) 1-(2-tallowylamidoethyl)-2-tallowyl imidazolinium methylsulfate.

22. The concentrate of claim 21 wherein the nonionic surfactant is selected from the group consisting of glycerol monoesters of fatty acids, ethoxylated fatty acids, and ethoxylated fatty alcohols.

23. A process for making an aqueous-based single-strength liquid fabric softener composition, the composition comprising:

(a) from about 0.4% to about 5% cationic fabric softener;

(b) from about 0.3% to about 1.2% hydrophobic perfume;

(c) from about 0.4% to about 5% nonionic surfactant;

(d) from 0% to about 1% water-soluble ionizable inorganic salt;

(e) from about 90% to about 98.5% water; and (f) from 0% to about 2% other conventional ingredients selected from the group consisting of enzymes, bactericides, inorganic acid, colorants, thickeners, soil release agents, antifoam agents, and chelants;

the composition having a ratio of cationic softener to perfume of from about 1:3 to about 5:1, and a ratio of cationic softener to nonionic surfactant of from about 1:2 to about 4:1; the amount of cationic softener plus nonionic surfactant being from about 1% to about 30%; the viscosity of the composition being from about 50 cp to about 500 cp; and the composition being a liquid aqueous phase with discrete hydrophobic particles of said perfume surrounded by said cationic softener and said nonionic surfactant dispersed substantially uniformly therein; the hydrophobic particles having a mean diameter of from about 4 microns to about 12 microns with 90% of the particles having a diameter of less than about 30 microns and 90% of the particles having a diameter greater than about 1 micron the process comprising the following steps:

(1) preheating the water to a temperature above the melting points of the cationic softener and the nonionic surfactant;

(2) optionally blending colorant and acid in the water;

(3) premixing the cationic softener and nonionic surfactant and heating them to a temperature at least about 50° C. above the water temperature, adding the premix to the water over a period with continuous high-speed agitation;

(4) optionally mixing other ingredients with the mixture from Step (3);

(5) adjusting the temperature of the mixture from Step (4) to about 40° C. to about 60° C., adding the perfume to such mixture over a period with high-speed agitation, continuing the agitation for at least about 1 minute after addition of the perfume is completed;

(6) optionally homogenizing the mixture from Step (5) using a high-sheer mixer;

(7) adding the water-soluble, ionizable inorganic salt, if any, to this mixture slowly enough to ensure that said ionizable inorganic salt is homogeneously blended in while the mixture is continuously agitated.

24. The process of claim 23 wherein the composition comprises:

(a) from about 1% to about 2% cationic softener;

(b) from about 0.5% to about 0.8% perfume;

(c) from about 0.8% to about 3% nonionic surfactant;

(d) from about 0.05 to about 0.4% water-soluble ionizable salt; and (e) from about 94% to about 97.5% water;

the composition having a ratio of cationic softener to perfume of from about 1:1 to about 3:1, and a ratio of cationic softener to nonionic surfactant of from about 1:1.5 to about 2:1; the composition being a liquid aqueous phase with discrete hydrophobic particles of said perfume surrounded by said cationic softener and said nonionic surfactant dispersed substantially uniformly therein; the pH of the composition being from about 2 to about 5; the hydrophobic particles having a mean diameter of from about 4 microns to about 12 microns with 90% of the particles having a diameter less than about 30 microns and 90% of the particles having a diameter greater than about 1 micron; the nonionic surfactant being selected from the group consisting of glycerol monoesters of fatty acids, ethoxylated fatty acids, and ethoxylated fatty alcohols; the water in Step (1) being heated to a temperature of from about 35° C. to about 70° C.; slowly adding the premix in Step (3) at a maximum rate of about 40 ml/min; slowly adding the perfume in Step (5) at a maximum rate of about 40 ml/min and continuing the agitation for at least about 2 minutes after addition of the perfume is completed; homogenizing the mixture in Step (6) at a temperature of less than about 30° C.; and slowly adding the salt in Step (7) over a period of at least about one minute with moderate-speed agitation, and continuing the agitation for at most about 2 minutes after addition of the salt is completed.

25. A process for making an aqueous-based concentrated liquid fabric softener composition, the composition comprising:

(a) from about 0.8% to about 24% cationic fabric softener;

(b) from about 0.6% to about 10% hydrophobic perfume;

(c) from about 0.8% to about 20% nonionic surfactant;

(d) from 0% to about 1% water-soluble ionizable inorganic salt;

(e) from about 60% to about 97% water; and (f) from 0% to about 10% other conventional ingredients selected from the group consisting of enzymes, bactericides, inorganic acid, colorants, thickeners, soil release agents, antifoam agents, and chelants;

the composition having a ratio of cationic softener to perfume of from about 1:3 to about 5:1, and a ratio of cationic softener to nonionic surfactant of from about 1:2 to about 4:1; the amount of cationic softener plus nonionic surfactant being from about 1% to about 30%; the viscosity of the composition being from about 50 cp to about 500 cp; and the composition being a liquid aqueous phase with discrete hydrophobic particles of said perfume surrounded by said cationic softener and said nonionic surfactant dispersed substantially uniformly therein; the hydrophobic particles having a mean diameter of from about 4 microns to about 12 microns with 90% of the particles having a diameter of less than about 30 microns and 90% of the particles having a diameter greater than about 1 micron the process comprising the following steps:

(1) preheating the water to a temperature above the melting points of the cationic softener and the nonionic surfactant;

(2) optionally blending colorant and acid in the water;

(3) premixing the cationic softener and nonionic surfactant and heating them to a temperature at least about 5° C. above the water temperature, adding the premix to the water over a period with continuous high-speed agitation;

(4) optionally mixing other ingredients with the mixture from Step (3);

(5) adjusting the temperature of the mixture from Step (4) to about 40° C. to about 60° C., adding the perfume to such mixture over a period with high-speed agitation, continuing the agitation for at least about 1 minute after addition of the perfume is completed;

(6) optionally homogenizing the mixture from Step (5) using a high-sheer mixer;

(7) adding the water-soluble, ionizable inorganic salt, if any, to this mixture slowly enough to ensure that said ionizable inorganic salt is homogeneously blended in while the mixture is continuously agitated.

26. The process of claim 25 wherein the composition comprises:

(a) from about 2% to about 15% cationic softener;

(b) from about 1% to about 8% perfume;

(c) from about 2% to about 15% nonionic surfactant;

(d) from about 0.05 to about 0.4% water-soluble ionizable salt; and (e) from about 80% to about 95% water;

the composition having a ratio of cationic softener to perfume of from about 1:1 to about 3:1, and a ratio of cationic softener to nonionic surfactant of from about 1:1.5 to about 2:1; the composition being a liquid aqueous phase with discrete hydrophobic particles of said perfume surrounded by said cationic softener and said nonionic surfactant dispersed substantially uniformly therein; the pH of the composition being from about 2 to about 5; the hydrophobic particles having a mean diameter of from about 4 microns to about 12 microns with 90% of the particles having a diameter less than about 30 microns and 90% of the particles having a diameter greater than about 1 micron; the nonionic surfactant being selected from the group consisting of glycerol monoesters of fatty acids, ethoxylated fatty acids, and ethoxylated fatty alcohols; the water in Step (1) being heated to a temperature of from about 35° C. to about 70° C.; slowly adding the premix in Step (3) at a maximum rate of about 40 ml/min; slowly adding the perfume in Step (5) at a maximum rate of about 40 ml/min and continuing the agitation for at least about 2 minutes after addition of the perfume is completed; homogenizing the mixture in Step (6) at a temperature of less than about 30° C.; and slowly adding the salt in Step (7) over a period of at least about one minute with moderate-speed agitation, and continuing the agitation for at most about 2 minutes after addition of the salt is completed.

* * * * *